US005123138A

United States Patent [19]

Flamm

[11] Patent Number: 5,123,138

[45] Date of Patent: Jun. 23, 1992

[54] SCRAPER BROOM

[76] Inventor: Brent Flamm, 5808 Rosario Blvd., North Highlands, Calif. 95660

[21] Appl. No.: 448,227

[22] Filed: Dec. 11, 1989

[51] Int. Cl.[5] ..... A47L 13/12

[52] U.S. Cl. ..... 15/111; 15/146; 15/159 R; 15/236.01

[58] Field of Search ..... 15/111, 114, 117, 104 S, 15/147 R, 146, 159 R, 160, 176.1, 236.01, 143 R, 236.06, 236.08; 30/169

[56] References Cited

U.S. PATENT DOCUMENTS

| | | | |
|---|---|---|---|
| 647,225 | 4/1900 | Graham | 15/111 |
| 722,017 | 3/1903 | Hayden et al. | 15/111 |
| 950,012 | 2/1910 | Bender | 15/111 |
| 1,424,291 | 8/1922 | Frank | 15/111 |
| 1,462,829 | 7/1923 | Roberts . | |
| 1,536,542 | 5/1925 | Wegner | 15/111 |
| 1,761,180 | 6/1930 | Cave et al. | 15/117 |
| 2,163,979 | 6/1939 | Judson | 15/111 |
| 2,666,221 | 1/1954 | Stepper | 15/146 |
| 2,689,967 | 9/1954 | Mackey | 15/172 |
| 2,867,827 | 1/1959 | Gantz | 15/111 |
| 3,034,165 | 5/1962 | Christian | 15/114 |
| 3,050,762 | 8/1962 | Ballinger | 15/147 R |
| 3,084,369 | 4/1963 | Hawkins | 15/236 |
| 3,094,728 | 6/1963 | White | 15/111 |
| 3,097,384 | 7/1963 | Clark | 15/111 |
| 3,307,212 | 3/1967 | MacInnes | 15/111 |
| 3,995,345 | 12/1976 | Larsson | 15/111 X |
| 4,785,489 | 11/1988 | Van Doehren | 15/111 |

FOREIGN PATENT DOCUMENTS

| | | | |
|---|---|---|---|
| 886736 | 8/1953 | Fed. Rep. of Germany | 15/111 |
| 29501 | 3/1919 | Norway . | |
| 15400 | of 1887 | United Kingdom . | |
| 15305 | of 1913 | United Kingdom . | |
| 2150015 | 6/1985 | United Kingdom | 15/111 |

*Primary Examiner*—Philip R. Coe
*Assistant Examiner*—C. Cooley
*Attorney, Agent, or Firm*—Joseph E. Gerber

[57] ABSTRACT

A frame for a scraping and sweeping tool is disclosed, the frame including a generally cylindrical, handle-receiving ferrule, a first length of angle stock being bound in perpendicular relation thereto such that one of its planes lies in perpendicular relation to the ferrule's axis and has an edge that projects beyond the periphery of the ferrule's tip. A second length of angle stock lies parallel to the first, and one of its edges is bound to the projecting edge of the first. A point on the exterior angle of this second length of stock is bound to the ferrule. The ferrule includes a rectangular block at its tip to aid in supporting the lengths of stock. Fasteners bind a scraper blade to the first length of angle stock and a broom head to the second.

13 Claims, 3 Drawing Sheets

SCRAPER BROOM

BACKGROUND OF THE INVENTION

1. Field Of The Invention

The present invention relates generally to push brooms, and more specifically to such brooms having apparatus for scraping combined therewith.

2. Description Of The Related Art

Tough floor cleaning jobs, such as on sites of new construction, require apparatus able to loosen debris adhered to the floor as well as to sweep it away. Similar apparatus is needed for breaking up ice and sweeping it from frozen sidewalks, and the like. In response to these needs, various brooms including scraping apparatus have been developed. Such devices typically comprise a conventional broom fitted with a blade for scraping. They are observed to fall into two general groups.

The first type is characterized by the scraper blade being at an angle substantially non-parallel with the axis of the broom. For example, U.S. Pat. No. 1,462,829 issued to Roberts in 1923 shows a broom bearing a scraper attachment and a replaceable blade. Similarly, Great Britain Patent No. 15,400 issued to Kallend in 1887 shows various blades including integral supports for strengthening the junction between the broom's head and handle And, Norwegian Patent No. 29,501 issued to Skjaeggerud in 1919 shows a blade interposed between a broom and its handle. All these devices have an inherent weakness in that, for vigorous and heavy-duty use, force axial to the handle is likely to bend or brake the blade.

A related device is shown in Great Britain Patent No. 15,305 issued to Wright in 1913. Therein, a blade is spring-mounted to a broom head. Once out of line with the handle's axis, the blade would be subject to breakage.

The aforementioned problem is somewhat lessened in a second type of device. These are characterized by the scraper blade being substantially parallel with the broom handle's axis. For example, U.S. Pat. No. 2,689,967 issued to Mackey in 1954 shows such a device. However, Mackey's broom head is supported by receipt of a single, short projection from the broom handle, this making a wooden broom head prone to splitting. Further, Mackey's blade and broom head are vulnerable to tangential forces due to their each having only a single point of support.

Two references, one being U.S. Pat. No. 3,094,728 issued to White in 1963, and the other being U.S. Pat. No. 3,084,369 issued to Hawkins in 1963, employ similar means for blade attachment to brooms. Both disclose brooms wherein a bolt binds the handle to the broom head, the blade being fixed between the handle and the head. Tangential force could cause such blades to rotate. And, Judson in U.S. Pat. No. 2,163,979 issued in 1939 discloses an add-on scraper for a broom. Even though this appears to be a more sturdy design in that it attaches to the broom's handle as well as to its head, its proper use is only directed to combination with a broom head having an auxiliary aperture for receipt of the handle.

Thus, it appears that a need exists for a scraping and sweeping tool that incorporates a blade substantially in line with its handle, and supported in a manner not prone to separation or misalignment therefrom. Further, it is desirable that the tool be able to receive various conventional broom heads. And, either its blade or its broom head should be able to be removed and replaced without removing or disturbing the position of the other.

SUMMARY OF THE INVENTION

The scraper broom tool of the present invention is adapted to overcome the foregoing problems In the broadest sense, it is a frame to which a handle may be affixed, and upon which a scraper and a broom head may be mounted. It, first, comprises a handle-receiving ferrule able to be bound to the end of an elongate handle. To the end of the ferrule, a first length of angle stock is bound with its linear dimension in perpendicular relation to the ferrule's longitudinal axis. This first length is oriented, and its planes are dimensioned such that, one of its planes lies in perpendicular relation to the ferrule's axis and has an edge that projects beyond the periphery of the ferrule's tip.

A second length of angle stock lies parallel to the first, and one of its edges is bound to the above-mentioned projecting edge of the first length. This second length of angle stock is also bound, at a point on its exterior angle, to the ferrule. The ferrule may include a rectangular block at its tip to aid in supporting the lengths of stock.

The forgoing elements may be combined with means for fastening a scraper blade to that plane of the first length lying parallel to the ferrule's longitudinal axis. And, means may also be included to permit fastening a broom head to the second length of stock, such that the broom head is cradled against its interior surfaces.

The relationship of the first and second lengths of angle stock permits the blade to be substantially in line with the handle, and causes the broom head to be tilted to an angle from the handle for its proper use. Yet, the device is simple to construct and exploits the inherent strength of angle stock for rigidity against forces from all directions. Further, this construction permits changing either the scraper blade or the broom head without disassembly of the other. And, the device may be fitted with various styles of broom heads and scrapers without major modification.

Thus, it is an object of the present invention to provide a combined scraping and sweeping tool that is simple, strong and economical to construct.

It is a feature of the present invention that the scraping and sweeping tool herein employs a pair of uniquely oriented lengths of angle stock to support a scraper blade and broom head at the best angle for their respective uses.

It is an advantage of the present invention that a scraping and sweeping tool that permits changing either the scraper blade or the broom head without disassembly of the other is provided.

Yet another advantage of the present invention is the provision of a scraping and sweeping tool able to receive various styles and sizes of broom heads and scrapers.

Still further objects, features and advantages of the inventive scraper broom disclosed herein will be apparent from the drawings and following detailed description thereof.

DESCRIPTION OF THE PREFERRED EMBODIMENT

Figure 1:
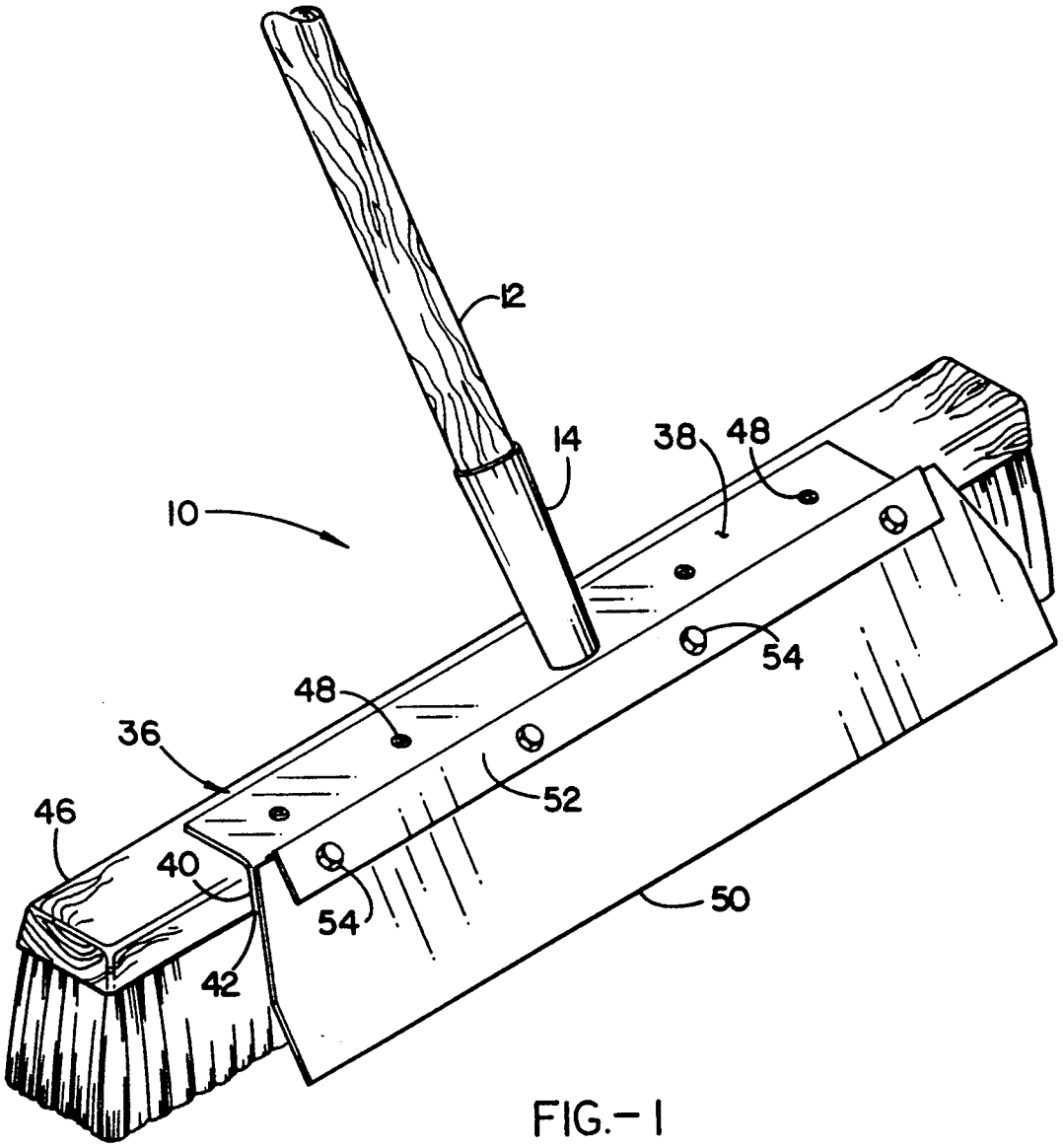
FIG. 1 is a perspective view of the working end of the scraper broom of the present invention resting, as it would, on a sweeping surface.

Referring now specifically to the drawings, FIGS. 1 through 5 show the inventive scraper broom tool generally designated herein by reference numeral 10. An elongate shaft of conventional construction forms handle 12. Any stiff material will suffice, wood being preferred.

At one end of handle 12, a generally cylindrical ferrule 14 is securely disposed. Ferrule 14 comprises a sleeve of rigid material, preferably steel. And, at its distal end, or terminus, ferrule 14 includes an integrally-bound rectangular block 16 projecting therefrom. As is most evident in FIG. 2, block 16 has four of its five faces oriented parallel to handle 12's longitudinal axis. These parallel faces are identified with reference numeral 18. And its fifth, or distal, face 20 is oriented perpendicular to that axis. Block 16 is preferably of steel. A length of three quarters of an inch and a width of one half inch has been found satisfactory for parallel faces 18. In this case, distal face 20 is one half inch square.

Using block 16 as an anchoring point, apparatus for mounting both a scraper blade and a broom head are provided. Specifically, to block 16, a first length of angle stock 22 is bound in perpendicular relation to the longitudinal axis of handle 12.

The angle stock used herein is rectilinear and has its two planes oriented at right angles to one-another, as is conventional. Here, and in the claims, it is understood that each plane has an interior and an exterior surface The line along which the two interior surfaces meet is the interior angle of the length of stock, and the line along which the exterior surfaces meet is the exterior angle. Such stock is preferably of steel.

The linear dimension found satisfactory for this first stock length 22 is approximately sixteen inches. And, one of its planes 24 is wider, at about one and a quarter inches in width, while its other plane 26 is narrower at a width of about one inch.

The point at which block 16 is bound approximately bisects first stock length 22 Distal block face 20 abuts the interior surface 28 of wider plane 24, and one parallel block face 18 abuts the interior surface 30 of narrower plane 26. Thus, block 16 nests against the interior angle 32 of stock length 22. This arrangement causes the outer edge 34 of wider plane 24 to project somewhat beyond the periphery of distal block face 20.

Block 16 and stock length 22 are preferably joined by welds at their points of contact.

A second length of angle stock 36 is oriented parallel to first stock length 22, this having wide 38 and narrow 40 planes of approximately two inches and one inch, respectively. The edge 42 of narrow plane 40 is bound, preferably by welds, to edge 34 of stock length 22.

Stock length 36 is also bound, at the approximate midpoint of its exterior angle 44, to block 16. Welds are, again, preferred.

The longitudinal dimension of stock length 36 is similar to length 22.

Figure 2:
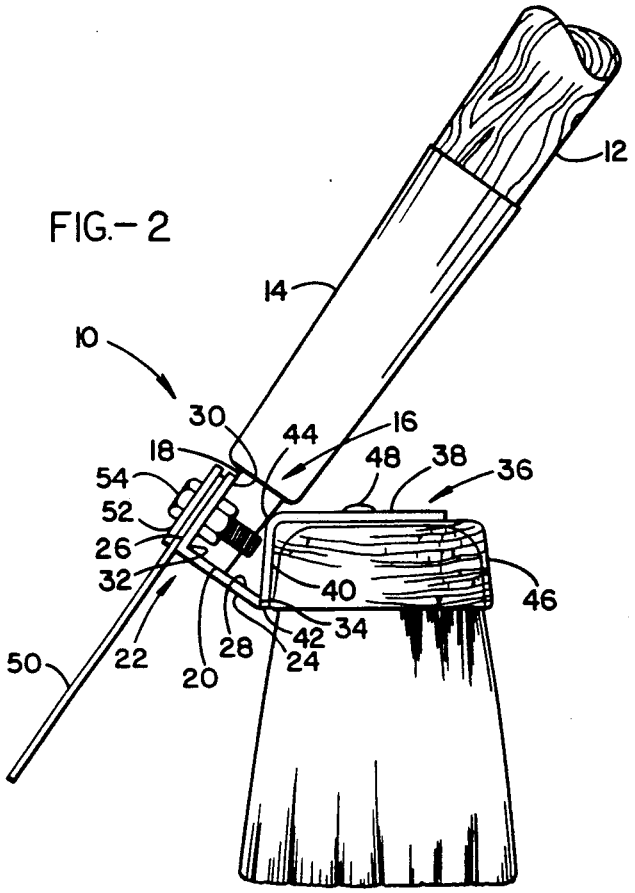
FIG. 2 is a side elevational view of the scraper broom of FIG. 1.
Figure 3:
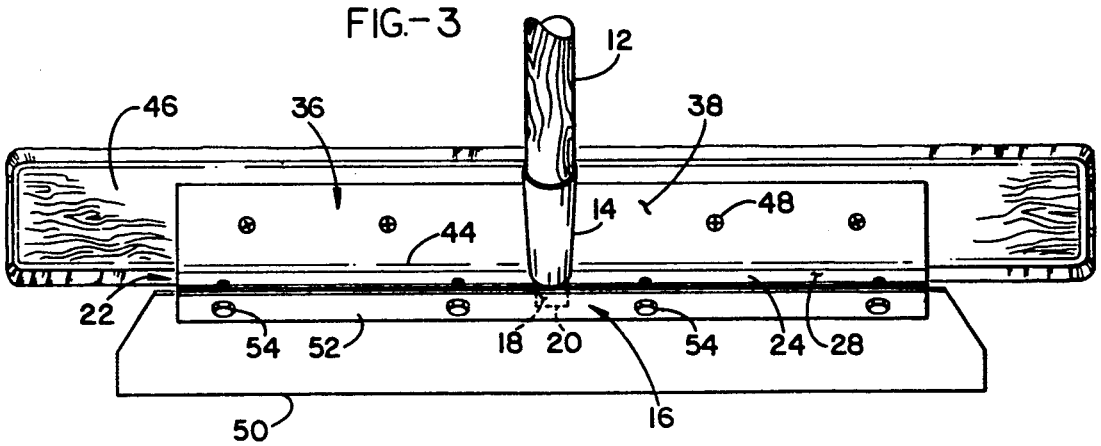
FIG. 3 is a plan view of the scraper broom of FIG. 1.
Figure 4:
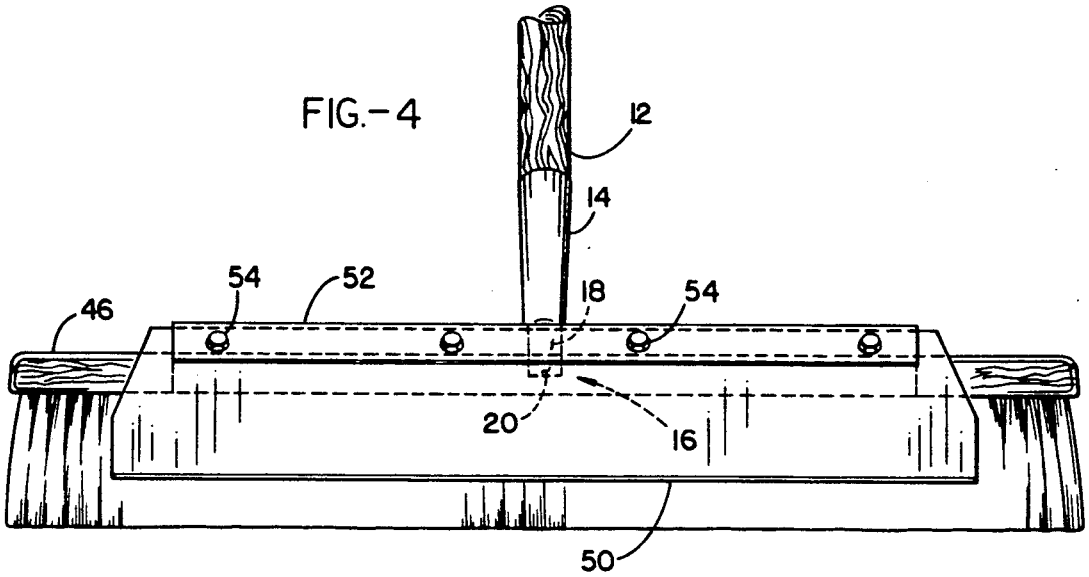
FIG. 4 is a front view of the scraper broom of FIG. 1.
Figure 5:
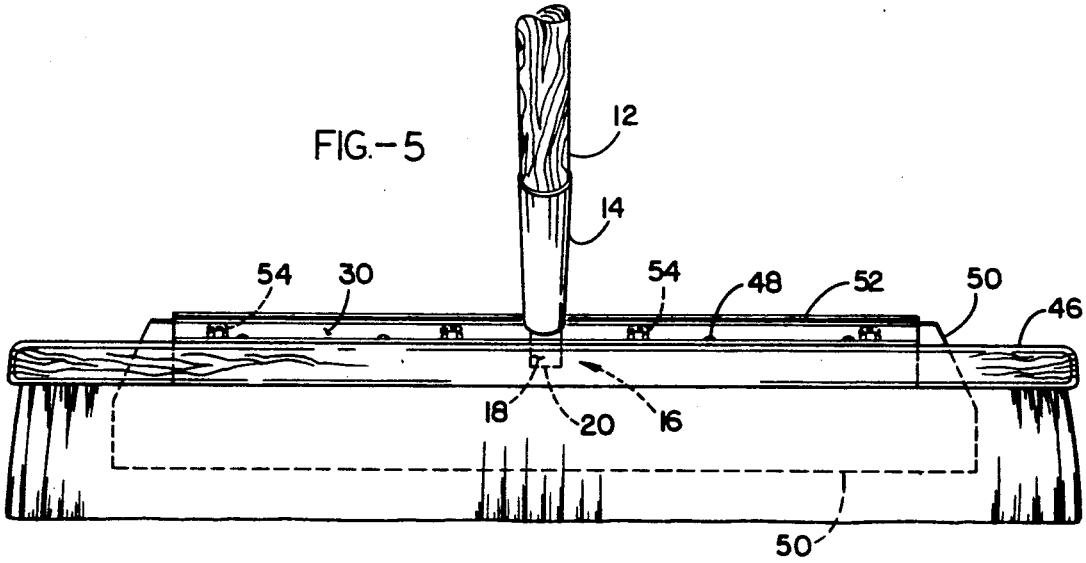
FIG. 5 is a rear view of the scraper broom of FIG. 1.

The stated widths of planes 24 and 40 set plane 40 at roughly a 35 degree angle from handle 12's longitudinal axis as best shown in FIG. 2. And, wide plane 38 is therefore set at roughly a 55 degree angle. Thus, stock length 36 is oriented so as to be able to cradle a broom head 46, as is best shown in FIGS. 1 and 2. This orientation is preferred so as to achieve the best, most comfortable angle for the broom head.

It will be noted that stock length 22 may be oriented with the exterior surface of its wider plane abutting distal block face 20, and its narrower plane oriented distal to block 16 and parallel with handle 12's axis, without losing the proportions necessary for the preferred angles herein.

Apertures are provided through plane 38 for receipt of fastening means such as wood screws 48, wood being the most commonly used material in broom heads.

For scraping, a metal blade 50 is fastened to plane 26 of stock length 22. This places blade 50 substantially in line with the axis of handle 12. Blade 50 may be bound to plane 26 by any conventional means. However, it has been found satisfactory to provide aligned apertures in plane 26, blade 50 and a retaining bar 52, and to bind these together with bolts 54.

Blades approximately as long as stock lengths 22 and 36, and four to five inches in width, have been found to work well; but, blades with different dimensions may be useful for different purposes.

Although the inventive scraper broom tool herein is described in its complete form, it is contemplated that similar advantages may be derived from the basic frame of the tool. That is, a frame unit comprising two lengths of angle stock in combination with a ferrule in the orientation described above is considered independently novel and inventive. This unit may be affixed to a handle, and a broom head and a scraper blade may be attached, to yield a tool with the abilities described above.

Further, the means for fastening a scraper blade and a broom head to their respective lengths of angle stock may alternatively be carried on the scraper or broom head.

In use, the inventive scraper broom may be operated as follows. First, in use as a scraper, force may be applied along the handle's axis to lift and loosen debris adhered to a surface. The scraper is so constructed as to accommodate forces in other directions as well, without misalignment of the blade, and without its separation from the tool.

Once the debris is loose, a simple flip of the wrist will rotate the tool 180 degrees about its handle's axis, permitting its broom head to seek the lowest center of gravity at just the right angle for comfortable sweeping. The orientation of the two lengths of angle stock, with respect to one another, permits this.

The broom head, being fastened to its respective length of angle stock at a plurality of points, is much less likely than conventional designs to become misaligned or to crack. Further, this fastening means is able to accommodate many different styles of broom head, whether or not they are designed to mate with this tool. In fact, even broom heads previously cracked during use with other broom head mountings may be salvaged for continued use with the tool herein.

When it becomes necessary to replace the scraper blade, it is easily accomplished without disturbing the manner in which the broom head is affixed. Bolts 54 are merely removed and replaced. Likewise, the broom head may be changed without disturbing the blade by removing and replacing screws 48.

The foregoing detailed disclosure of the inventive scraper broom 10 is considered as only illustrative of the preferred embodiment of, and not a limitation upon the scope of, the invention. Those skilled in the art will envision many other possible variations of the structure disclosed herein that nevertheless fall within the scope of the following claims. And, alternative uses for this inventive device may later be realized. Accordingly, the scope of the invention should be determined with reference to the appended claims, and not by the examples which have herein been given.

I claim:

1. A frame for a scraping and sweeping tool comprising, in combination:

a. a ferrule adapted to receive an elongate handle, said handle having a longitudinal axis;

b. a first length of angle stock, comprising two intersecting planes, bound to said ferrule with said first length of said angle stock's linear dimension in perpendicular relation to a longitudinal axis of said ferrule, said length having a first plane oriented parallel to said ferrule's longitudinal axis for fastening a scraper blade thereto, said scraper blade being substantially parallel to said ferrule's longitudinal axis, said first length further being oriented and dimensioned such that the other one of its planes lies in perpendicular relation to said ferrule's longitudinal axis, said other plane of said first length having an edge that projects beyond the periphery of a tip of said ferrule; and, c. a second length of angle stock comprising two planes intersecting at right angles, said second length being parallel to said the first length of angle stock, one of said second length's edges being bound to that edge of said first length of stock which projects beyond said ferrule's tip's periphery, said second length of stock also being bound, at a point on its exterior angled portion, to said ferrule, said second length of stock's planes being oriented to present therein interior faces for fastening a broom head thereagainst such that said broom head will meet a floor at a comfortable sweeping angle.

2. The tool of claim 1 including means for fastening said scraper blade to said first plane of said first length of angle stock.

3. The tool of claim 2 wherein said means comprises a retaining bar.

4. The tool of claim 1 including means for fastening said broom head to said second length of angle stock.

5. The tool of claim 1 wherein an interior surface of said first length of angle stock is bound to said ferrule.

6. The tool of claim 1 wherein one plane of said second stock length is set at approximately a 55 degree angle from said handle's longitudinal axis.

7. The tool of claim 1 wherein said ferrule includes a rectangular block at its terminus, said block having four faces oriented parallel to said longitudinal axis of said handle and one distal face oriented perpendicular thereto.

8. The tool of claim 7 wherein the exterior angled portion of said second length of angle stock is bound to said rectangular block of said ferrule.

9. A scraping and sweeping tool comprising, in combination:

a. an elongated handle;

b. a ferrule bound to an end of said handle;

c. a first length of angle stock, said length being bound to said ferrule in perpendicular relation to a longitudinal axis of said handle, said length further being oriented and dimensioned such that a first plane thereof lies in perpendicular relation to said handle's axis, said plane having an edge that projects beyond the periphery of a tip of said ferrule;

d. a second length of angle stock parallel to said first length of angle stock, one of its edges being bound to that edge of said first length of stock which projects beyond said ferrule's periphery, said second length of stock also being bound, at a point on its exterior angled portion, to said ferrule;

e. means for fastening a scraper blade to said first length of angle stock on a second plane of said first length, said second plane being oriented parallel to said handle's axis; and, f. means for fastening a broom head to said second length of angle stock such that said broom head is cradled against the interior surfaces of said second length.

10. The tool of claim 9 wherein a terminus of said ferrule comprises a rectangular block, said block having four faces oriented parallel to said handle's axis and one distal face oriented perpendicular thereto.

11. The tool of claim 10 wherein one interior surface of said first length of angle stock is flush with one of said parallel block faces, and wherein the other interior surface thereof is flush with said perpendicular block face.

12. The tool of claim 9 wherein one plane of said second stock length is set at approximately a 55 degree angle from said handle's axis.

13. A scraper broom comprising, in combination:

a. an elongated handle having a longitudinal axis;

b. a ferrule bound to an end of said handle, a terminus of said ferrule comprising a rectangular block, said block having four faces oriented parallel to an axis of said handle and one distal face oriented perpendicular thereto;

c. a first length of angle stock comprising two intersecting planes; said first length being perpendicular to said handle and bound to said block at the approximate center of said length, on parallel block interior surface of the first plane being flush with one of said parallel block faces, and the interior surface of the other plane being flush with said perpendicular block face and, further, being of substantially greater width than, and projecting beyond the periphery of, said perpendicular face;

d. a second length of angle stock parallel to the first, one of its edges being bound to that edge of said first length which projects beyond said perpendicular face's periphery, said second length also being bound, at a point on its exterior angled portion, to said block;

e. means for fastening a scraper blade to said first length of angle stock on said first plane of said first length oriented parallel to said handle's longitudinal axis; and, f. means for fastening a broom head to said second length of angle stock such that said broom head is cradled against said length's interior surfaces.

* * * * *